United States Patent [19]

Ganter

[11] Patent Number: 4,626,108

[45] Date of Patent: Dec. 2, 1986

[54] WRISTWATCH WITH SEAL

[75] Inventor: Wolfgang Ganter, Schramberg, Fed. Rep. of Germany

[73] Assignee: Gebruder Junghans GmbH, Schramberg, Fed. Rep. of Germany

[21] Appl. No.: 741,948

[22] Filed: Jun. 6, 1985

[30] Foreign Application Priority Data

Jun. 7, 1984 [DE] Fed. Rep. of Germany ..... 3421168

[51] Int. Cl.[4] ..... G04B 37/00

[52] U.S. Cl. ..... 368/291; 368/300; 368/309

[58] Field of Search ..... 368/276, 287, 291–292, 368/299, 300, 309

[56] References Cited

U.S. PATENT DOCUMENTS 3,479,771 11/1969 Steimann ..... 368/291
3,643,424 2/1972 Simon ..... 368/291
3,733,807 5/1973 Nolawa ..... 368/291
3,756,017 9/1973 Genta ..... 368/291
4,548,514 10/1985 Ganter ..... 368/291

*Primary Examiner*—Vit W. Miska
*Attorney, Agent, or Firm*—Burns, Doane, Swecker & Mathis

[57] ABSTRACT

A wristwatch comprises an outer case having a longitudinal retaining bore. A hollow, generally cylindrical plastic seal is disposed in the bore. The seal includes upper and lower portions, the lower portion being of reduced diameter. The upper portion includes a radial notch and an upper recess disposed above the notch. The lower portion includes a radially inwardly projecting flange and a lower recess disposed below the flange. A watch movement includes a collar which is seated on the flange so as to be radially and longitudinally positioned within the seal. A watch face is disposed above the movement and is mounted in the notch. The watch face engages the watch movement to longitudinally retain the watch movement. A crystal is mounted in the upper recess, and a bottom cover is mounted in the lower recess.

2 Claims, 1 Drawing Figure

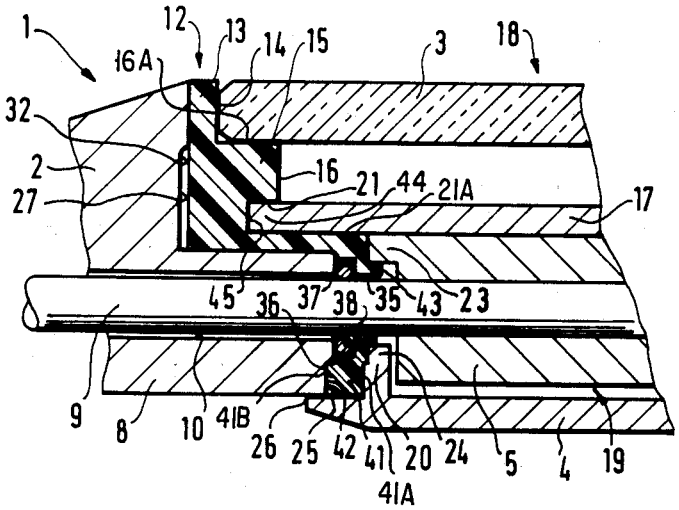
1
12
13
14
15
3
18
16A
32
2
27
16
21
44
21A
17
45
36
37
38
35
43
23
9
8
10
41B
26
25
42
41
20
24
5
4
19
41A

WRISTWATCH WITH SEAL

BACKGROUND AND OBJECTS OF THE INVENTION

The invention relates to a wristwatch of the type in which a hollow cylindrical seal is disposed within an outer casing. The watch crystal and bottom cover are mounted within the seal, the seal being formed of a hard synthetic plastic. The bottom cover includes an upright wall against which a radial collar of the watch movement bears. Such an arrangement is disclosed in U.S. application Ser. No. 06/584,339, filed Feb. 28, 1984, now U.S. Pat. No. 4,548,514.

In such a case, complications might arise during assembly because the collar on conventional watch movements does not project radially very far. By providing even a slight radial tolerance between the wall and the movement, it is possible that an inadequate engagement between the wall and collar may occur, especially if the cover is inserted in a skewed manner, i.e., tilted with respect to the axis of the seal. Furthermore, such an arrangement wherein the watch movement telecopes into the wall of the cover is very expensive to fabricate in cases where the watch movement has a non-circular cross-sectional shape.

It is readily possible to insert between the collar of the movement and the wall of the bottom cover a conventional bottom ring which protrudes radially beyond the wall and can be conveniently provided with an internal diameter which corresponds to the geometry of the watch movement. This accommodates a greater radial tolerance between the movement and the wall of the cover, but also is more costly in terms of parts and their assembly. In addition, the radial dimension of the seal and thus the outer case is undesirably increased in such an instance.

It is, therefore, an object of the invention to provide an arrangement in which a proper orientation of the watch movement is assured and is not dependent upon the orientation of the bottom cover.

Another object is to minimize the radial dimension of the seal and outer case.

An additional object is to minimize the cost of the watch.

Yet another object is to multiply the number of possible uses for a seal of the above-mentioned type.

One further object is to simplify the manufacture and assembly of a watch mechanism of that type.

SUMMARY OF THE INVENTION

These objects are achieved by the present invention which relates to a wristwatch comprising an outer case which includes a longitudinal retaining bore. A hollow, generally cylindrical seal is disposed in the retaining bore. The seal comprises a tube of hard synthetic plastic material and includes an inner wall. The inner wall includes an upper portion, and a lower portion of reduced diameter. The upper portion includes a radial notch and an upper recess disposed above the notch. The lower portion includes a radially inwardly projecting flange, and a lower recess disposed below the flange. A watch movement includes a collar, the collar being seated on the flange and radially engaging a portion of the inner wall so as to be radially and longitudinally positioned within the seal. A watch face is disposed above the movement and includes outward projections received in the notch. A crystal is received in the upper recess, and a bottom cover is received in the lower recess.

The placement of the collar 23 upon the flange 43 assures that the watch movement will be accurately oriented regardless of the orientation of the bottom cover 4. Furthermore, the radial dimension of the seal, and thus of the outer cover is minimized in the area of the watch movement.

BRIEF DESCRIPTION OF THE DRAWING

Additional alternatives and further developements, together with additional characteristics and advantages of the invention will become apparent from the discription below of a preferred embodiment of the invention, shown in the drawing in a simplified manner, stricted to the essential components:

The single FIGURE of the drawing shows a wristwatch in a cross-section through its key-stem, in a greatly enlarged and broken view.

DETAILED DESCRIPTION OF A PREFERRED EMODIMENT OF THE INVENTION

A wristwatch outlined in cross-section in the drawing comprises essentially a single piece case 2 with a movement 5 installed in a water-tight manner between a watch crystal 3 and a bottom cover 4. The wall 8 of the case is penetrated by a key-stem 9 (along with a stem bore 10), which engages the movement 5.

For the sealing of the inside of the wristwatch 1 a single piece gasket 12 is disposed in a retaining bore 27 of the case 2. The gasket 12 is in the form of an axially short tube 13 extending over the height of the case 2, with a stepped internal diameter and profiled inner and outer walls. The tube 13 comprises an injection molded part of a hard, synthetic plastic material exhibiting little cold flow and (even over a wide range of temperature) good creep strength and capable of being processed with high dimensional accuracy by the injection molding process, while subsequently retaining a certain plasticity. A suitable material based on polyester elastomers is commercially available under the designation of "Hytrel R", but polyamides and acetal resins may also be considered.

The upper half of the tube 13 has a larger mean diameter defined by an internal wall 14. An annular projection 15 projects toward the inside of the tube and serves as an offset 16 between the crystal 3 and the watch face 17 abutting downward against the movement 5. The projection 15 defines a radial shoulder 16A upon which the outer peripheral portion of the crysal 3 is situated. The latter is supported downward against a part 43 of the tube 13 with a reduced diameter frictionally in the axial direction and simultaneously radially encompassed.

An upper opening 18 of the sealing tube 13 is sealed hermetically by the watch crystal 3 pressed into it with a radial frictional seat in the inner wall 14 of the tube and surrounded in the manner of a clamping ring by the case 2. During the axial insertion of the crystal 3, the sealing tube 13, which is not yet encompassed from the outside by the rigid case 2, may be slightly expanded. Thus, there occurs no optically detrimental material deformation, which could also be damaging to the seal. Nor will there occur damage (such as the peeling-off of chips on the inner wall 14 of the tube) during installation. The opposite opening 19 on the bottom side of the tube 13 is hermetically sealed by a relatively small bottom cover 4, held by the tube 13 in a radially frictional manner. The bottom cover 4 secures the entire assembly shown against radial displacement relative to the case 2, following the enclosure of the tube by the case 2.

The bottom cover 4 is equipped with an axially short circumferential wall 20, which engages a reduced-diameter (i.e., inwardly stepped) lower area of the tube 13 over a slight distance only. For the purpose of being able to be introduced without damage into the lower tube opening 19, the bottom wall 20 is tapered at its upper end to assume a locating pin profile 24, i.e., the wall upper end is recessed radially inwardly relative to the lower end of the wall 4. To enclose the lower front 25 of the sealing tube 13, the latter is overlapped by a bottom part of the case 2.

In keeping with the stepped configuration of the axial cross-section of the wall of the tube 13, the retaining bore 27 in the case 2 also comprises a step defined by a lower part of the case 2 in which a key-stem bore 10 is disposed. In the area of the seal retaining bore 27 located coaxially thereabove, a retaining groove 32 is provided into which the tube 13 may expand in order to retain the tube within the case 2.

The tube 13 has a transverse bore 35 for the radial passage of the key-stem 9. In an outer wall 36 of the tube 13, a recess 27 is provided to receive an O-ring 38 which sealingly surrounds the key-stem 9. The lowermost portion of the retainer bore 27 has a step-like recess defined by a portion 42 of the bore, in which for further sealing between the case 2 and the sealing tube 13, a socket part 41 of the tube 13 extends. That socket part 41 includes a longitudinally extending inner surface 41A and a longitudinally extending outer wall 41B, the latter engaging the portion 42 of the casing 2. The radially outer surface of the wall 20 of the bottom cover 4 engages the inner surface 41A.

The key-stem bore 35 of the tube 13 is partially defined by a flange 43 which projects toward the inside of the tube to define a step. That step serves to radially enclose and axially support a circumferential collar 23 of the movement 5. The movement 5 is pressured axially against the flange 43 by the watch face 17. The face 17 includes radial projections 44 which are received in a notch 45 disposed in the inner wall 14 of the tube below the projection 15. The notch 45 includes radially extending upper and lower faces 21, 21A, respectively. The lower surface 21A extends radially inwardly as far as the radially outward extent of the collar 23.

To assembly the wristwatch 1, initially the movement 5 is axially inserted from above into the opening 18 until the collar 23 abuts the protruding flange 43. The movement is thereby positioned both axially and radially and is pressured frictionally against the flange 43 by a watch face 17 which is then clamped into the tube 13. The face 17 thus serves as an axial retaining plate for the movement 5. Subsequently, above the water face 17, the hands may be set onto the hand arbors (not shown). Then, the sealing tube 13 is closed-off in the area of its larger upper opening 18 by the crystal 3, which is pressed into abutment against the projection 15 of the tube.

After this, the key-stem gasket 38 is inserted into the wall recess 37 of the tube 13, and then the sealing tube 13 is radially enclosed by pressing the tube into the case in order to create the radial forces which impose a sealing action on the watch crystal 3, and a radial clamping action on the face 17 and the movement 5. The key-stem 9 may then be inserted radially through the case bore 10, the O-ring 38 and the sealing tube bore 35, into the movement 5, where in a known manner it is lockedin. Finally, the entire assembly is sealed watertight by the insertion of the axially short wall 20 of the bottom cover 4 from below into the smaller, lower opening 19 of the lower, tapering part of the tube 13. Insertion of the cover 4 does not affect the position of the movement 5 in the sealing tube 13, because the wall 20 is spaced apart radially and axially from the movement 5 and its collar 23, respectively.

The battery may be replaced by removing the bottom cover 4, or through an opening in the bottom, as is conventional. To remove the movement 5, the crystal 3 is extracted form the upper tube opening 18 by means of a so-called Bergeon pump known in the watchmaker trade. Then, with the bottom cover 4 and the key-stem 9 removed, the stepped sealing tube 13, together with the watch face 17 and movement 5 still seated in it, is pressured out from the case 2 in the upward direction. Thereafter, the watch face and the movement 5 may be removed upwardly from the tube 13.

As a result of the afore-described invention, even the simplest face may be used without the provision of fastening pinches and without the requirement of mounting screws. The face serves as a retaining ring for longitudinally constraining the movement 5 in the upward direction. The movement 5 is longitudinally constrained in the downward direction by the flange 43.

The placement of the collar 23 upon the flange 43 assures that the watch movement will be accurately oriented regardless of the orientation of the bottom cover 4. Furthermore, the radial dimension of the seal, and thus of the outer cover, is minimized in the area of the watch movement which is advantageous in round wristwatches and in watches with molded housings.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. A wristwatch comprising:

an outer case including a longitudinal retaining bore, a hollow, generally cylindrical seal disposed in said retaining bore, said seal comprising a tube of hard synthetic plastic material including an inner wall, said inner wall including an upper portion and a lower portion of reduced diameter, said upper portion including a radial notch and an upper longitudinal recess disposed above said notch, said notch including upper and lower radial faces, said upper recess including a longitudinally extending wall and a shoulder extending radially inwardly from a lower end of said longtudinally extending wall, said lower portion including a radially inwardly projecting flange, and a lower longitudinal recess disposed below said flange, said tube including a longitudinally extending inner surface defining a portion of said lower recess, and a longitudinally extending outer wall disposed radially outside of said inner surface, said outer wall engaging a portion of said retaining bore, a water movement having a collar seated on said flange and radially engaging a portion of said inner wall to be radially and longitudinally positioned within said tube, said portion of said inner wall pressing radially against said collar in a fluidresistant manner, a watch face disposed above said movement and including a planar outer periphery received in said notch and making area contact with said lower face of said notch, said watch face engaging an upper end of said watch movement and urging said collar longitudinally against said flange, a crystal disposed in said upper recess such that an outer peripheral portion of said crystal sits upon said shoulder and said longitudinally extending wall presses radially inwardly against said outer peripheral portion, and a bottom cover received in said lower recess, said bottom cover including an upwardly extending wall disposed internally of said lower recess so as to extend longitudinally alongside said movement in radially spaced relationship therewith, a radially outer surface of said upwardly extending wall engaging said inner surface of said lower recess in a fluid-resistant manner.

2. A wristwatch according to claim 1, wherein said lower radial face of said notch extends radially inwardly as far as a radially outward edge of said collar.

* * * * *